US005794223A

United States Patent [19]

Gallagher et al.

[11] Patent Number: 5,794,223

[45] Date of Patent: Aug. 11, 1998

[54] METHOD FOR CONTROL OF LENGTH OF IMPRINT FOR A MAILING MACHINE

[75] Inventors: Dennis M. Gallagher, Danbury; John R. Nobile, Fairfield; Thomas M. Pfeifer, Bridgeport; William A. Ross, Darien; Richard P. Schoonmaker, Wilton, all of Conn.

[73] Assignee: Pitney Bowes Inc., Stamford, Conn.

[21] Appl. No.: 203,461

[22] Filed: Feb. 28, 1994

[51] Int. Cl.[6] ..... G07B 17/00

[52] U.S. Cl. ..... 705/408; 364/479.05; 705/401

[58] Field of Search ..... 364/464.02, 479.05; 101/71; 705/400, 401, 408, 410

[56] References Cited

U.S. PATENT DOCUMENTS

| | | | |
|---|---|---|---|
| 3,869,986 | 3/1975 | Hubbard | 101/91 |
| 4,168,533 | 9/1979 | Schwartz | 364/464.02 |
| 4,407,462 | 10/1983 | Tajima et al. | 242/331.2 |
| 4,416,200 | 11/1983 | Yon | 101/228 |
| 4,580,144 | 4/1986 | Calvi | 347/171 |
| 4,584,047 | 4/1986 | Vanderpool et al. | 156/361 |
| 4,831,554 | 5/1989 | Storace et al. | 364/464.02 X |
| 5,122,967 | 6/1992 | Gilham | 364/479.05 |
| 5,373,450 | 12/1994 | Gallagher et al. | 364/464.02 X |
| 5,415,484 | 5/1995 | Gallagher et al. | 400/621 |

*Primary Examiner*—Edward R. Cosimano

*Attorney, Agent, or Firm*—Steven J. Shapiro; Melvin J. Scolnick

[57] ABSTRACT

A method for controlling a tape motor using a microcontroller for feeding tape in correspondence to printing of an indeterminate length of printing on the tape by a print drum utilizes a sensor for indicating a tape condition which changes in accordance with the engagement of a printing portion of the print drum with the tape. An optical sensor and slotted disk provide signals indicative of the rotation of a motor shaft of the tape motor. At least first and second counters are provided for counting signal pulses from said optical sensor corresponding to the passage of slots during rotation of the motor. From these counts and the indication of printing by the print drum, the micro controller can develop the timing of control signals for controlling the motor in correspondence to the length of printing on the tape.

10 Claims, 10 Drawing Sheets

TAPE CYCLE - NO AD PLATE

TAPE CYCLE - WITH AD PLATE

METHOD FOR CONTROL OF LENGTH OF IMPRINT FOR A MAILING MACHINE

FIELD OF THE INVENTION

The invention relates to mailing machines and more particularly tape dispensing units associated with the mailing machines.

BACKGROUND OF THE INVENTION

This application is related to the following five applications concurrently filed directed to a tape feeding, cutting and ejecting apparatus for a mailing machine: Ser. No. 08/203,132 for Roll-Tape Knife Control for a Tape-Cutting Apparatus in a Mailing Machine; Ser. No. 08/203,130 for Method for Preventing Jams in a Tape Ejecting Apparatus; Ser. No. 08/203,454 for Method for Initializing a Tape Feeding, Cutting and Ejection Apparatus for a Mailing Machine; Ser. No. 08/203,459 for Method for Controlling Speed in a Tape Feeding, Cutting and Ejection Apparatus for a Mailing Machine; and, Ser. No. 08/203,460 for Method and Apparatus for Cutting Mailing Machine Roll Tape, now U.S. Pat. No. 5,415,484 all assigned to the assignee of the present invention.

In addition it is related to the following applications Ser. No. 180,161 and Ser. No. 180,168 for Tape Feeding, Cutting and Ejecting Apparatus for a Mailing Machine filed Jan. 11, 1994 and Ser. No. 180,163 for Mailing Machine also filed Jan. 11, 1994, all assigned to the assignee of the present invention.

Mailing machines are well known. Generally, mailing machines comprise a postage meter for printing an indicia on a piece of mail or on a tape and a feed base for transporting mailpieces or tapes for printing by the postage meter. Tape feeding mechanisms have typically not been incorporated into small mailing machines because of the costs involved.

One of the requirements of these tape feed mechanisms is that they must accommodate both short lengths of tape as well as longer lengths which may include such things as advertising slogans or other materials desired by the user or required by postal authorities. Typically in mailing machines the operator either must use a single length of tape or select between a long and a short tape length depending on whether the advertising was desired.

Applications Ser. No. 180,161 and Ser. No. 180,168 for Tape Feeding, Cutting and Ejecting Apparatus for a Mailing Machine and Ser. No. 180,163 for Mailing Machine previously mentioned above, describe a mailing machine in which the conveyor motor for transporting mailpieces is supplied with signals by an optical sensor and slotted wheel for providing count pulses for position location and speed measurement. A slack loop sensor is also shown for detecting an out of tape condition.

Ser. No. 08/203,461 for Method and Apparatus for Cutting Mailing Machine Roll Tape, filed concurrently herewith and specifically incorporated by reference herein describes and claims various aspects of the present invention.

U.S. 4,584,047 to Vanderpool, et al describes a labelling device which includes a microprocessor control system using feedback information from a timing disk that includes a number of marks which provide signals indicating the actual position of the labels on an associated web of material. U.S. 4,416,200 to Yon shows a web controlled by photocells which detect a slack loop.

SUMMARY OF THE INVENTION

It is therefore an object of the invention to provide a method for software control of the feeding of a roll tape to enable the mailing machine to accommodate any desired length of printed tape segment.

This and other objects are attained by a method for controlling a tape motor using a microcontroller for feeding tape in correspondence to printing of an indeterminate length of printing on the tape by a print drum. In accordance with the invention there is provided a sensor for indicating a tape condition which changes in accordance with the engagement of a printing portion of the print drum with the tape. An optical sensor and slotted disk provide signals indicative of the rotation of a motor shaft of the tape motor. At least first and second counters are provided for counting signal pulses from said optical sensor corresponding to the passage of slots during rotation of the motor. From these counts and the indication of printing by the print drum, the micro controller can develop the timing of control signals for controlling the motor in correspondence to the length of printing on the tape.

DESCRIPTION OF THE PREFERRED EMBODIMENT

Figure 1:
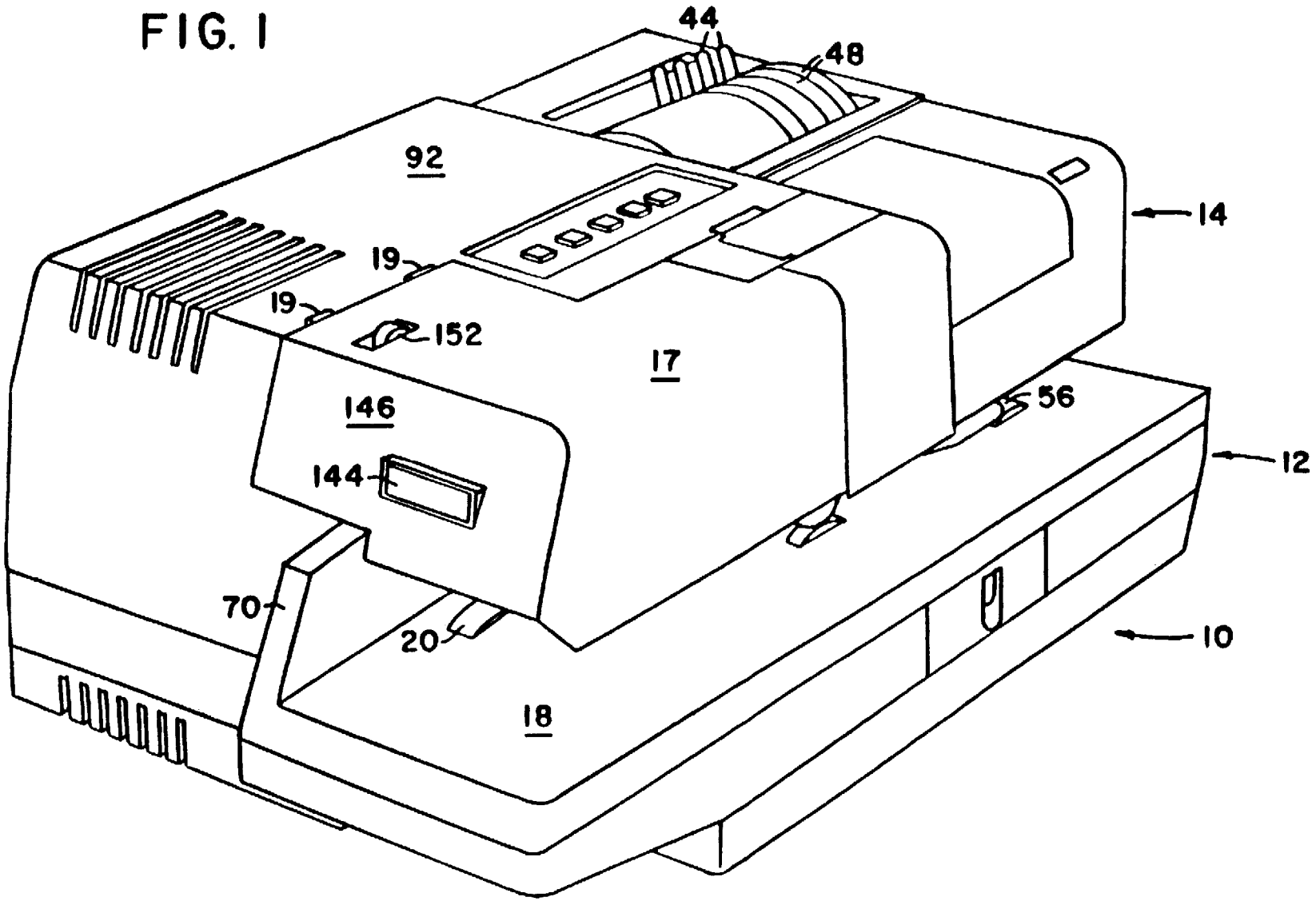
FIG. 1. is a general perspective view of a mailing machine embodying the present invention.
Figure 2:
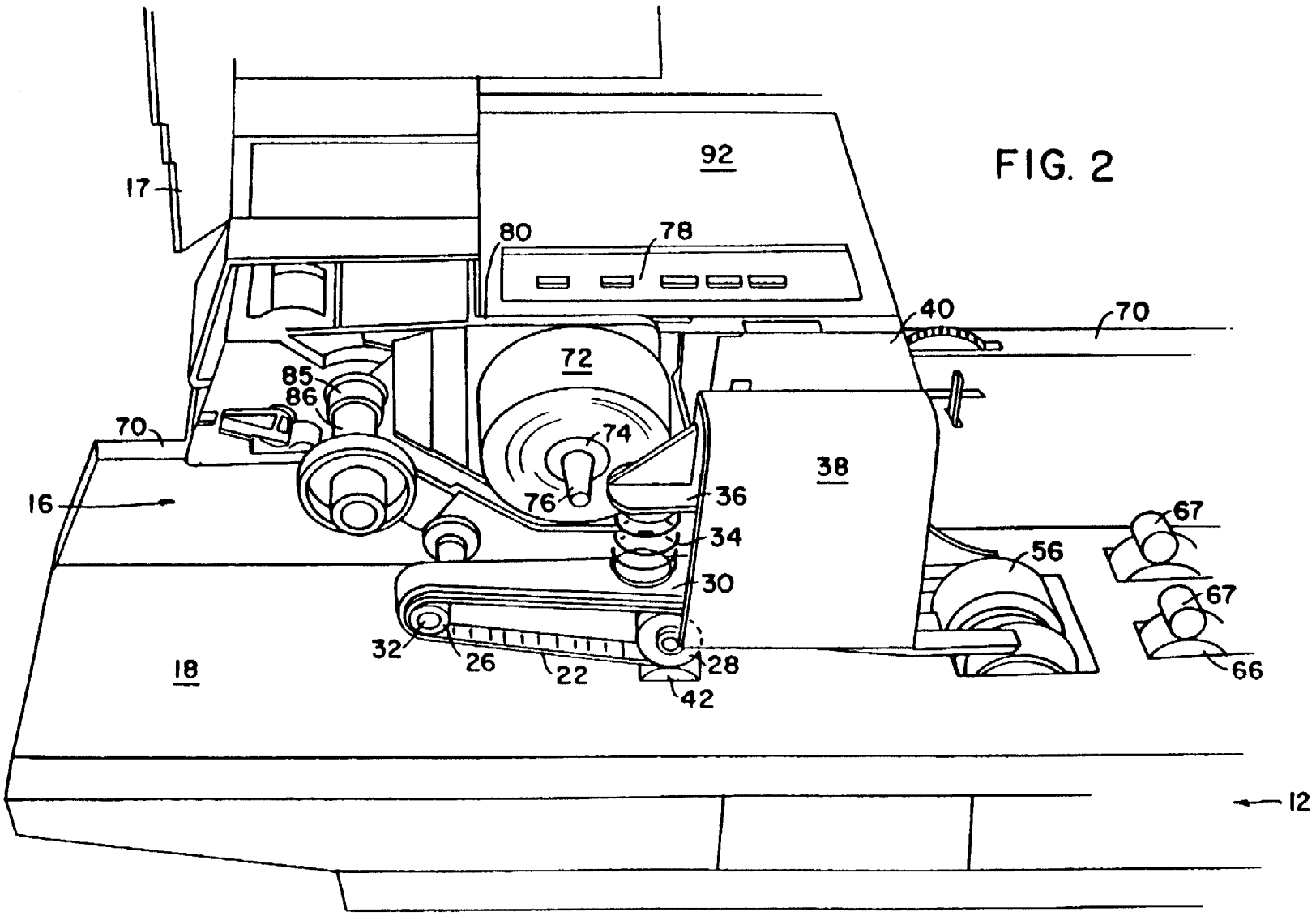
FIG. 2 is a frontal perspective view of the mailing machine shown in FIG. 1 with some covers removed to expose details.

In FIGS. 1 and 2, there is shown generally at 10 a mailing machine as described generally in applications Ser. No. 180,163 for Mailing Machine, Ser. No. 180,161 and Ser. No. 180,168 for Tape Feeding, Cutting and Ejecting Apparatus for a Mailing Machine all filed Jan. 11, 1994, each assigned to the assignee of the present invention and specifically incorporated herein by reference.

The mailing machine includes a base shown generally at 12, a postage meter generally designated at 14, and a tape feeding, cutting, and ejection apparatus shown generally at 16 (FIG. 2). The mailing machine preferably includes a housing having a pivoted cover 17 connected by hinges 19 which can be raised to provide access.

The base 12 comprises a feed deck 18 which extends through the mailing machine 10 for support of mailpieces. Feeding rollers 20 project upward through the deck for engaging the underside of the mailpieces while belt 22 which extends around drive pulley 26 and idler pulley 28 serves to engage the upper surface for transporting the mailpiece for feeding to the postage meter. The outer surface of belt 22 passing around idler pulley 28 is mounted on elongate housing 30 which is pivoted about shaft 32 which drives the pulley 26. Housing 30 is spring loaded downwardly by spring 34 on bracket 36 formed on ink cartridge housing 38 which holds a removable ink cartridge 40. Belt 22 engages an idler roller 42 mounted beneath the feed deck 18 which acts as a pressure backup to ensure proper feeding of mailpieces between the belt 22 and idler roller 42.

Figure 3:
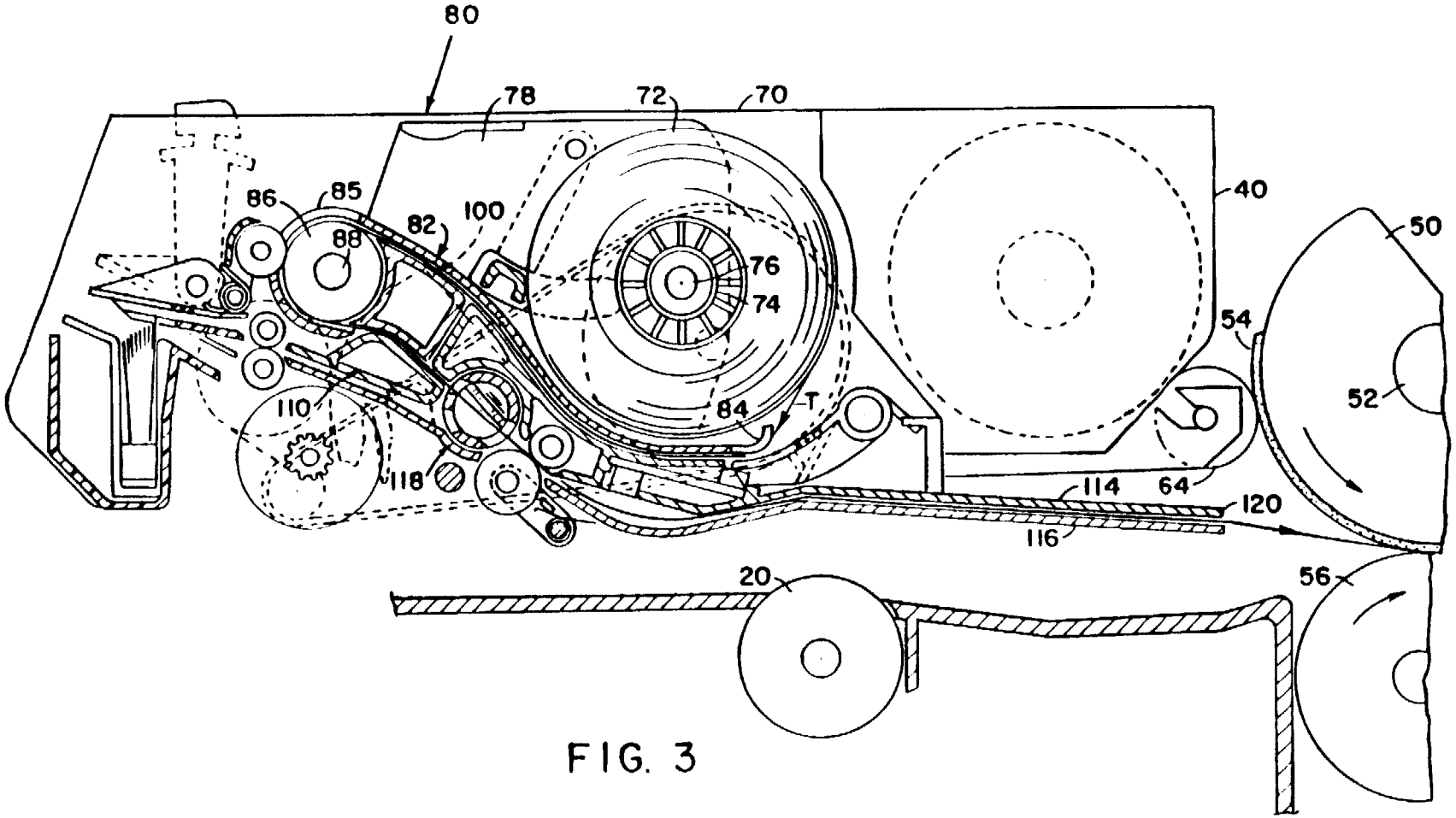
FIG. 3 is a view of the tape feeding, cutting and ejecting apparatus shown in place in the mailing machine.

Postage meter 14 has a plurality of setting levers 44 for setting postage in accordance with numerals on scales 48. As seen in FIG. 3 the postage meter includes print drum 50 mounted on shaft 52 which is driven for rotation of the drum. Drum 50 carries a printing die 54 for printing the indicia on a mailpiece pressed into firm engagement by impression rollers 56. The ink cartridge 40 contacts spring loaded transfer roller 64 for transferring ink to the printing die 54 on each revolution of the printing drum.

Returning to FIG. 2, the base further includes a plurality of eject rollers 66 and cooperating spring loaded pressure rollers 67 for conveying the mailpiece to the end of the feed deck.

Figure 4:
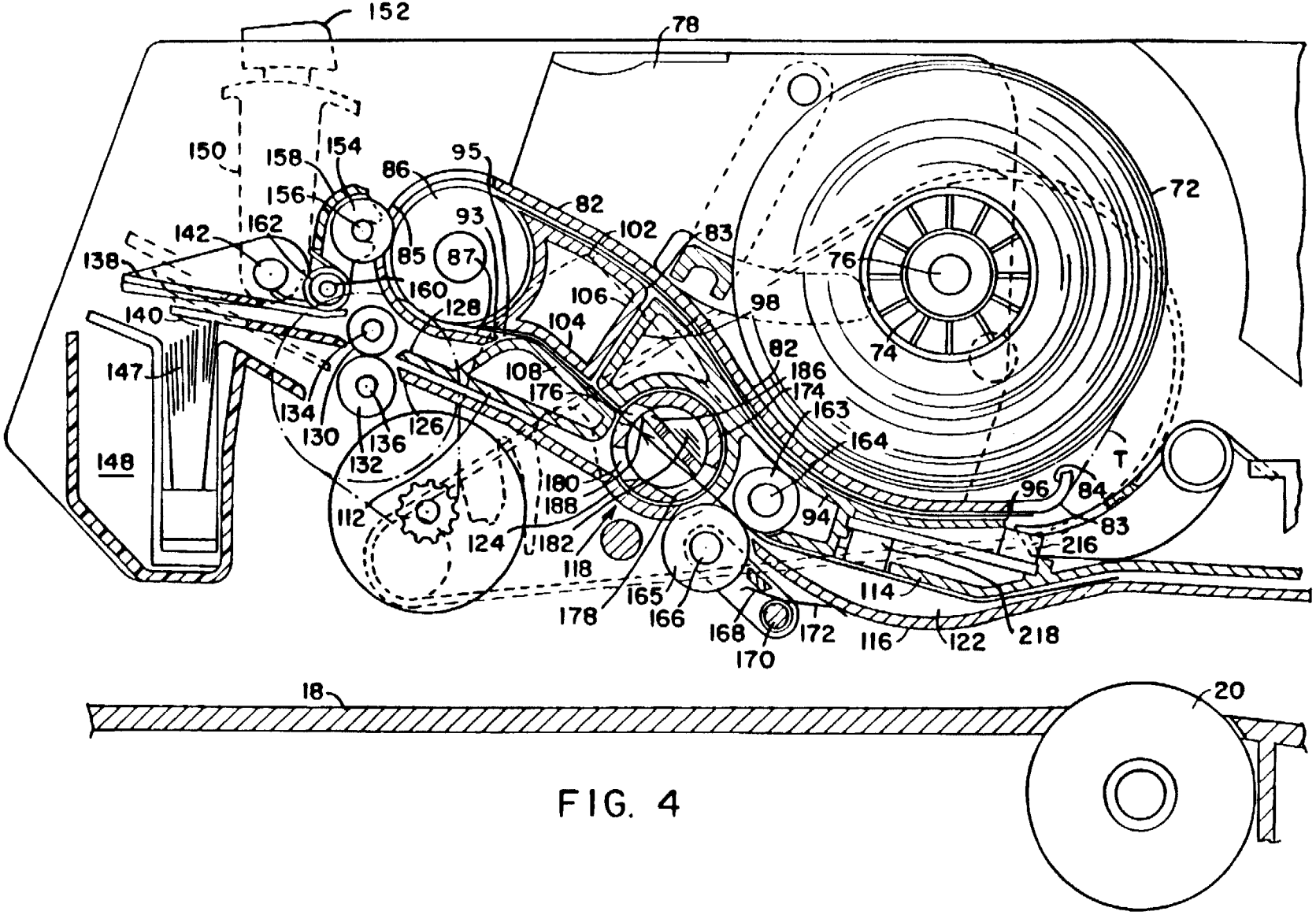
FIG. 4 is a view similar to FIG. 3 but drawn to enlarged scale and partly in longitudinal section to reveal particular details.

Referring now to FIGS. 3 and 4, the base 12 includes a wall 70 (also in FIGS. 1 and 2). The tape feeding, cutting and ejection apparatus 16 is mounted on the wall 70. Apparatus 16 includes a roll of tape 72 suitably mounted on spindle 74 which in turn is mounted on tape holding means which includes stub shaft 76 fixed to an upstanding wall 78 of a movable mounting frame designated generally at 80.

The mounting frame 80 also includes an upper guide plate 82 and has an upturned lip 84 which forms an entrance guide for the strip of tape "T" as it comes off the roll. The upper guide plate terminates in a pair of spaced apart U-shaped portions 85 which fit closely around the outer periphery of a drum shaped tape feed roller 86 fixedly mounted on shaft 88.

As best seen in FIG. 4, the strip is threaded through slot 83 formed formed by the lower surface of the upper guide plate 82 and guide wall 102. The U-shaped portions terminate in a flat portion 87 which is tapered to form a cutting edge 93 against which the free end of tape T is pulled , after it exits through slot 95 defined by edge 93 and guide wall 104. The lower guide plate 94 is disposed contiguously with guide plate 82 over most of its length commencing at end 96 and extending to wall 98.

An upper intermediate guide portion indicated at 100 is arranged in the space between wall 98 and tape feed roller 86 and includes the guide walls 102 and 104 and an upright wall 106 between the walls 102 and 104. The lower guide wall 104 is disposed in close relationship with an upper guide wall 108 of a lower intermediate guide portion designated by 110. This intermediate portion 110 has a lower guide wall 112.

A second set of guide plates 114 and 116 extend generally from a point adjacent a severing mechanism 118 to another point 120 adjacent the nip of the printing drum 50 and the impression roller 56. There is a short span where these guide plates are separated by a substantially larger distance to form a gap 122. The foregoing plates all define a first feed path for the tape.

Another elongate guide plate 124 extends rearwardly from beneath the severing mechanism 118 to an opposite end 126 . The lower guide wall 112 of the intermediate guide portion 110 also has an end 128 located adjacent to the end 126 of the guide plate 124. A pair of feed rollers 130 and 132 are mounted on shafts 134 and 136 respectively.

On the opposite side of the feed rollers 130 and 132 is a tape deflector having closely spaced apart upper and lower guide plates 138 and 140 which are suitably connected together to form an integral unit which is fixedly mounted on on shaft 142. The deflector plates 138 and 140 lead to an outlet opening 144 (FIG. 1) formed in the side wall 146 of the cover. Lever 150 is suitably connected to shaft 142 and terminates upwardly in in a finger button 152 which projects through a top wall 92 to allow the operator to oscillate the shaft 142 back and forth to move the deflector plates 138 and 140 between the solid lines and dotted line position seen in FIG. 4. It will be noted that with the plates in the solid line position, a cut piece of tape is directed under the deflector plate 140 and over the top of the bristles 147 of moistening device 148. If in the dotted position, the deflector plates prevent the tape from being moistened and it is sent directly to the opening 144.

The tape feeding means comprises tape feed roller 86 and idler roller 154 which is rotatably mounted on shaft 156 fixed in frame 158, which in turn is pivotally mounted on shaft 160. Coil spring 162 is wrapped around the shaft 160 so that the ends bear against the frame 158 and the upper surface of deflector plate 138 to urge the frame 158 toward the feed roller 86, and thereby pressing the idler roller 154 into firm engagement with the tape as it passes around the feed roller 86.

Another feed roller 163 is fixedly mounted on a shaft 164 which is rotatably mounted in the frame. A pair of backup idler rollers 165 are mounted on shaft 166 which is rotatably mounted in frame 168 which in turn is pivotally mounted on another shaft 170 which is mounted on the frame walls. Coil spring 172 is mounted on the shaft 170 to urge the idler roller 165 toward the feed roller 163 to provide firm driving engagement between the feed roller 163 and the tape.

It will be appreciated that the feed roller 86 and backup idler roller 158, the feed roller 163 and backup idler roller 165 are all in the first path and serve both to feed the tape and to bring it back to the point where the tape is severed. The set of feed rollers 130 and 132 are disposed in a second path for ejecting the severed piece of tape.

The severing mechanism 118 comprises a cylindrical tubular member 174. This member has a plurality of axially elongate slots through which the tape passes, both in forward and reverse movements. Slot 176 provides an entrance for the tape and a second slot 178 provides an exit. A third slot 180 is formed on the same side as slot 176 to provide an exit for the severed portion of the tape and to direct the tape into the second feed path for ejection of the tape.

A movable cutting member or knife 182 is rotatably mounted in the tubular member 174, the cutting member having a close tolerance fit within the member 174. The knife 182 has a flat surface 186 which is angled slightly and defining a sharpened edge 188 which functions as a moveable blade for cutting the tape when the cutting member 182 is rotated. When the blade moves, it not only severs the tape but depresses the leading edge of the cut piece of tape to the lower slot 180 to direct the cut piece into the second path.

The drive mechanism is implemented suitably with a DC reversing motor (not seen in these figures) as described in connection with Ser. Nos. 180,161 and 180,168, previously incorporated by reference herein. The result of the operation is that a tape is fed to the postage meter for imprinting along a first path and then the tape is reversed and the appropriate strip length is severed and the severed tape strip is ejected along the second path. The complete operation is described in this referenced application and will not be further described herein except as required for the discussion of the present invention.

As shown in FIG. 4, proximity sensor 218 is suitably mounted beneath a portion of upper guide plate 82 beneath an opening in the lower guide plate 94. This sensor is of the type that shines a beam of light on the surface of the tape which is reflected back so that the distance between the tape surface and the sensor can be determined.

Figure 5:
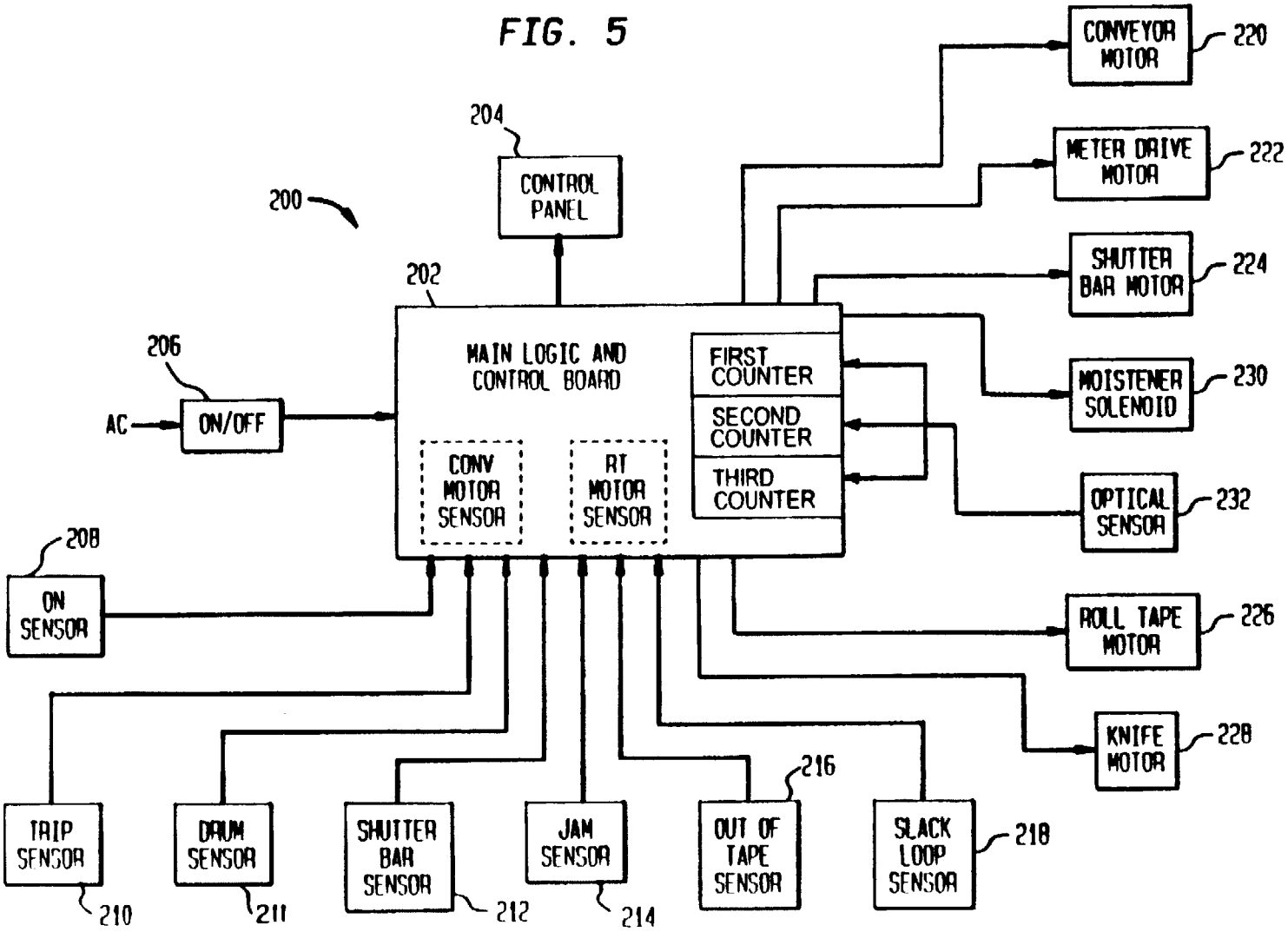
FIG. 5 is a schematic block diagram of the electronic components of the mailing machine.

FIG. 5 is a circuit block diagram of the mailing machine. As seen generally at 200, the main logic and control board 202 receives information from a control panel 204 when A/C power has been applied via on/off switch 206. Various sensors, such as those illustrated for determining the ON condition, 208; trip sensor, 210; drum sensor, 211; shutter bar sensor, 212; jam sensor, 214; out-of-tape sensor, 216; and slack loop sensor, 218 provide information to the control board 202 about the state of the machine while the board outputs information for driving the various motors and solenoids. These motors are the conveyor motor, 220; the meter drive motor, 222; the shutter bar motor, 224; the roll tape drive motor, 226; and the knife motor, 228. The board also provides control information to the moistener solenoid 230 and receives optical count data indicated here at block 232 from an optical sensor and slotted rotating disc operatively connected to the roll tape motor.

Figure 6:
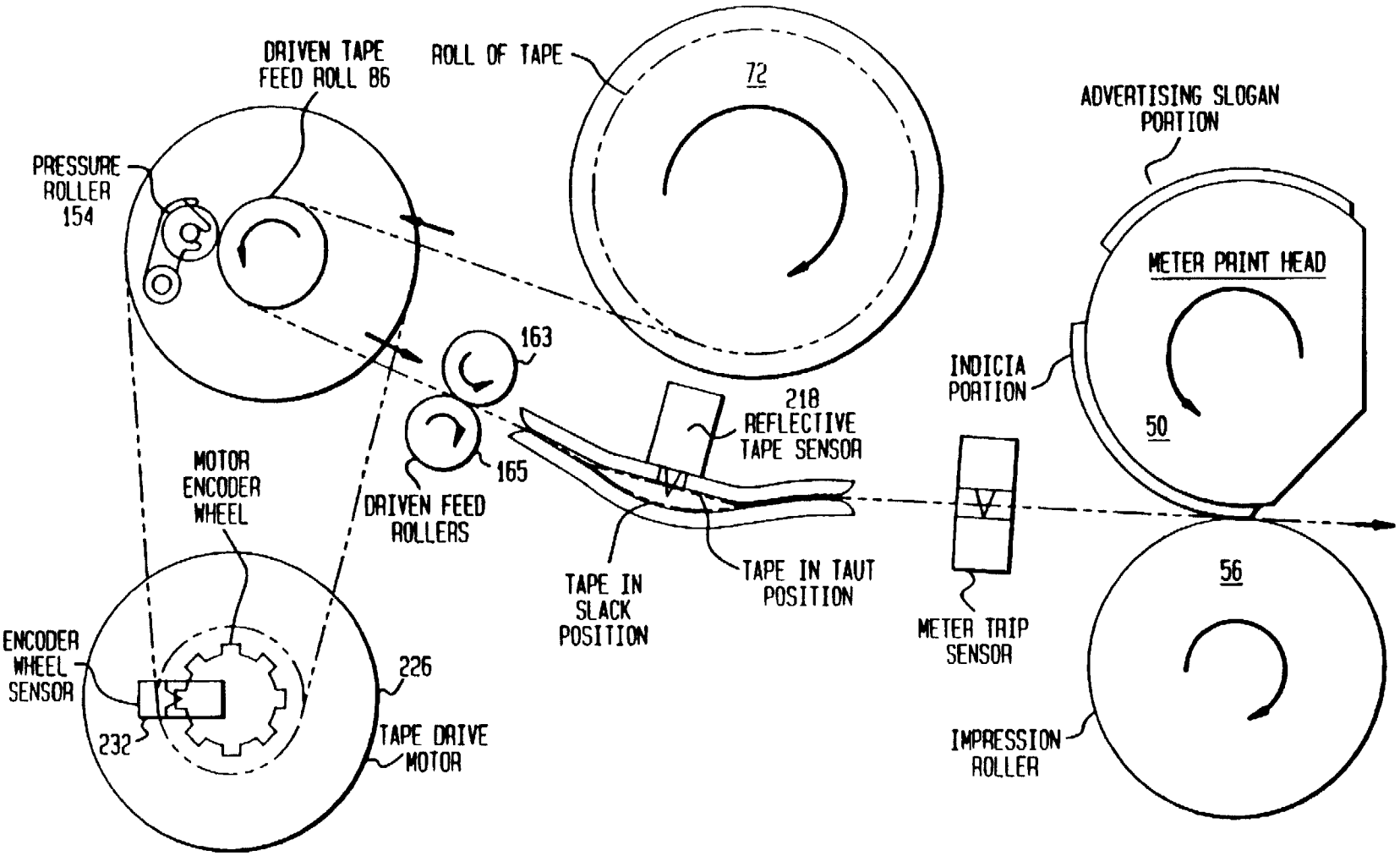
FIG. 6 is a schematic of the slack loop sensor arrangement for detection of the length of printing on the tape.
Figure 7A:
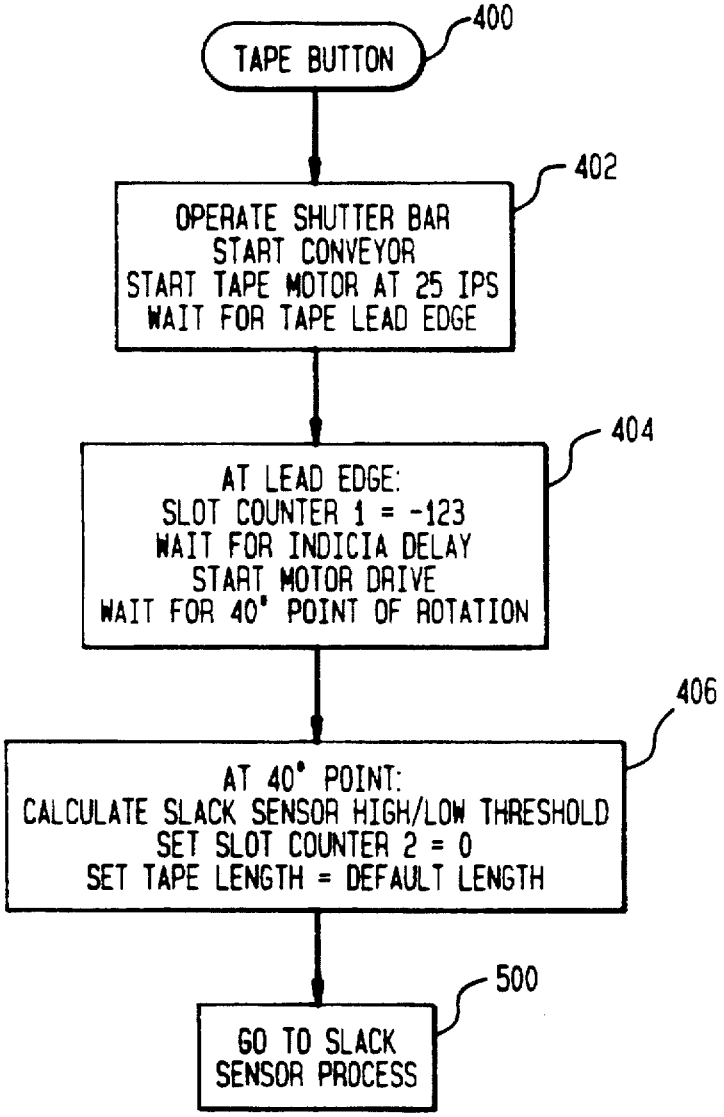
FIGS. 7*a* and 7*b* comprise a flow chart of the operation of the routine for control of tape length in accordance with the invention.
Figure 7B:
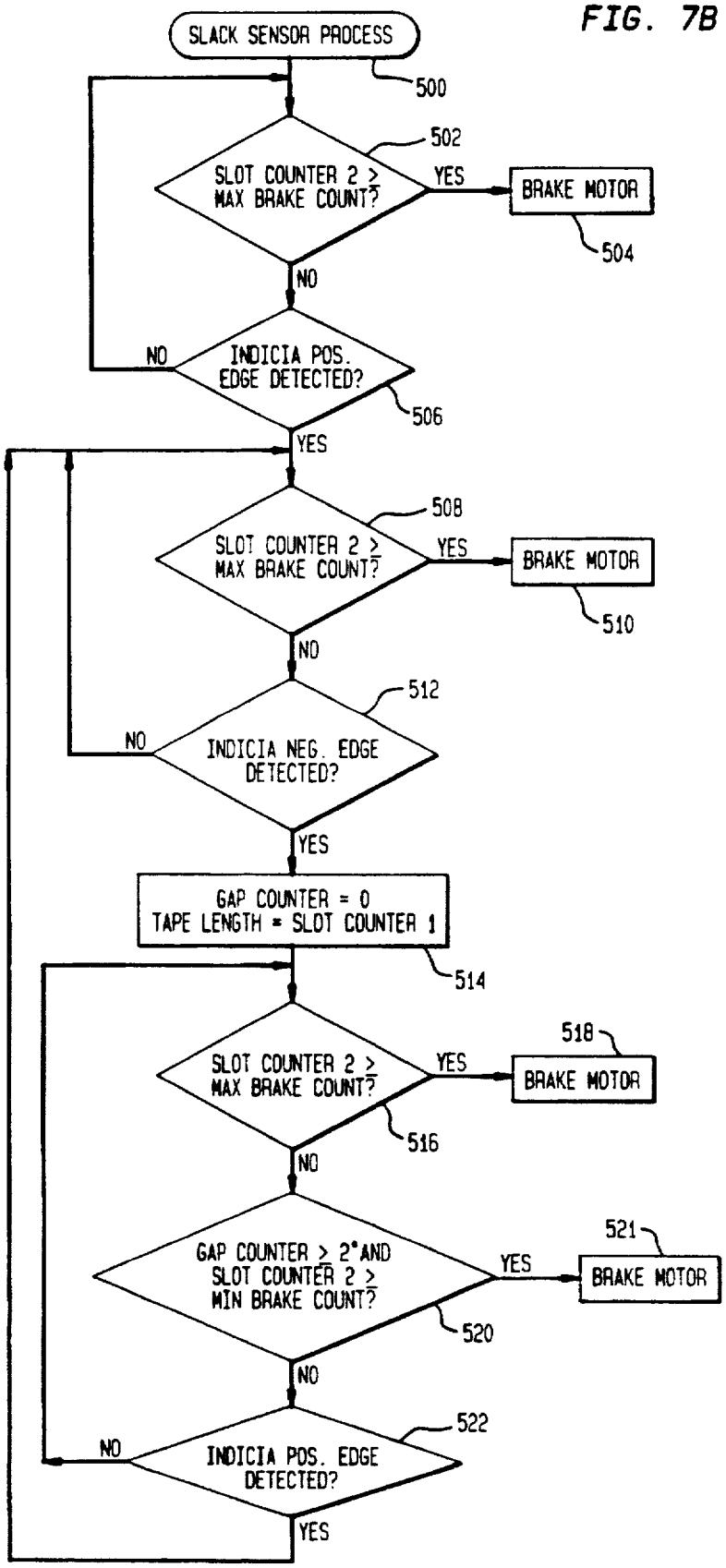

FIG. 6 is a schematic of the slack loop sensor arrangement for detection of the length of printing on the tape. The print drum contacts the tape only during printing of the indicia and ad plate. Slack loop sensor 218 is located at a point such that when the tape is pushed past it, the tape will move to the bottom of the track. The tape when pulled by the print drum during the printing operation will be pulled up against the top of the track. The speeds are deliberately slightly mismatched so that the speed of the print drum is about 5% faster than the speed of the tape. Thus as the tape is being printed it is being pulled by the meter print drum and the difference in signal from sensor 218 is used to determine the tape length based on the number of counts from the optical sensor slotted wheel combination.

FIGS. *7a* and *7b* comprise a flow chart of the operation of the routine for control of tape length in accordance with the invention. Turning to FIG. *7a*, the initiation of a print tape cycle at block 400 with operation of the tape button to operate the shutter bar, start conveyor, and start the tape motor operation, typically at about 25 ips, block 402. The program routine awaits detection of the tape lead edge at the trip sensor.

At detection, block 404, a first slot counter, slot counter 1, is set equal to −123. This counter counts the slots in the tape motor disk as they pass the associated optical sensor. It is set at −123 in order to subtract out the distance from the trip sensor to the to the print position. It will be understood that other slot signals and distances may be used as desired. In the preferred embodiment each slot is equivalent to approximately 0.035 inch of tape distance or in this case a total of about 4.3 inches. It will be understood from the foregoing that this slot counter provides the information as to the length of tape to be cut in terms of the slot count.

A wait state is initiated to account for the indicia delay and the motor drive is started and the 40 degree point of rotation is awaited.

At block 406 upon detection of the 40 degree rotation point, the slack sensor high/low threshold is calculated and a second slot counter, slot counter 2, is set to 0. The counter 2 is used to give a minimum and a maximum braking angle. At this point the tape length is set to a default length and the routine falls to the slack sensor process 500 illustrated in FIG. *7b*.

At block 502 slot counter 2 is checked to see if it is greater than or equal to the maximum brake count and if it has reached it the motor is braked, block 504. Preferably the maximum brake count is set at a slot count of 200 which is equivalent to approximately 300 degrees of rotation. If it has not reached the maximum a check is made, block 506, to determine whether the positive edge of the indicia is detected by the slack loop sensor. If not the program loops back and if it has been detected, the routine falls to again check first to see whether the maximum brake count in counter 2 has been reached, block 508, and if it has been reached, the motor is braked, block 510. If slot counter 2 is less than the maximum, the routine checks at block 512 to see whether the negative edge of the indicia has been detected by the slack loop sensor. If it has not, the program loops back, but when the negative edge is detected, the routine falls to block 514 where a gap counter is set to 0 and the tape length is set equal to the value of the slot counter 1. This timer prevents braking until approximately 2 inches after the most recent trailing edge, unless overridden by the maximum braking angle setting. This counter prevents the change in signal from the slack loop signal because of the gap between the indicia plate and the ad plate from triggering an unwanted braking of the motor before the ad plate has been printed.

For best results, it has been found that the tape motor speed should be increased, e.g. to 26 ips, upon detection of the positive edge and reduced again to its original value on detection of the negative edge.

The value in slot counter 2 is again checked, block 516, to see if it has reached the maximum brake count and if it has the motor is braked, block 518. If not the routine falls to block 520 to determine if both the gap counter is greater than the equivalent of 2 inches and whether slot counter 2 is greater than or equal to the minimum brake count, suitably 105 slots or approximately 180 degrees, and if both conditions are met the motor is braked, block 521.

If both conditions are not met the routine continues to block 522 to determine whether the positive edge of the slack loop sensor signal due to the ad plate has been detected and if not the program loops back to block 516. If it is detected the program loops back to block 508 to await the detection of the negative edge of the ad plate.

Figure 8:
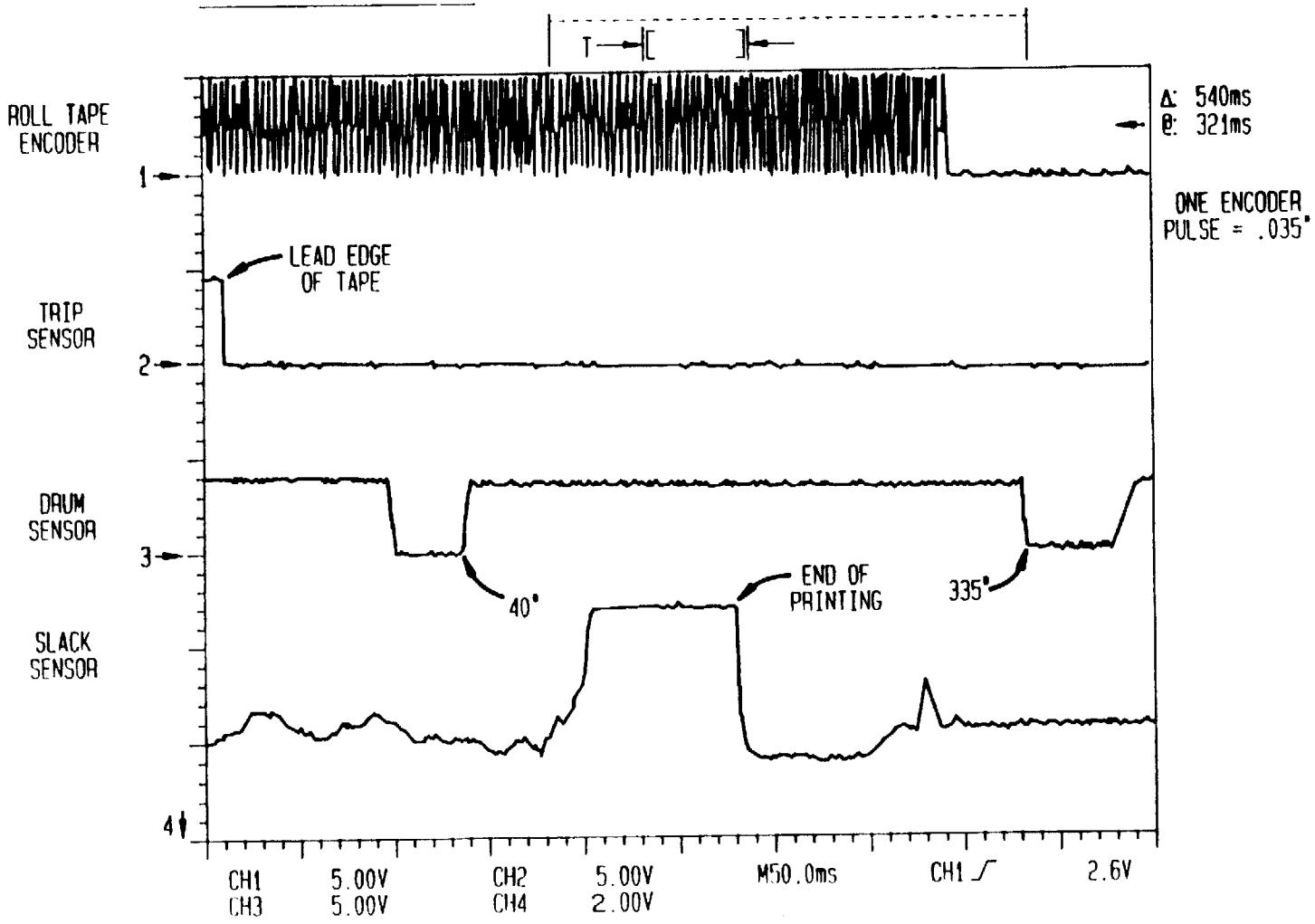
FIG. 8 is a timing plot of the signals showing the timing of a tape cycle without an ad plate being printed
Figure 9:
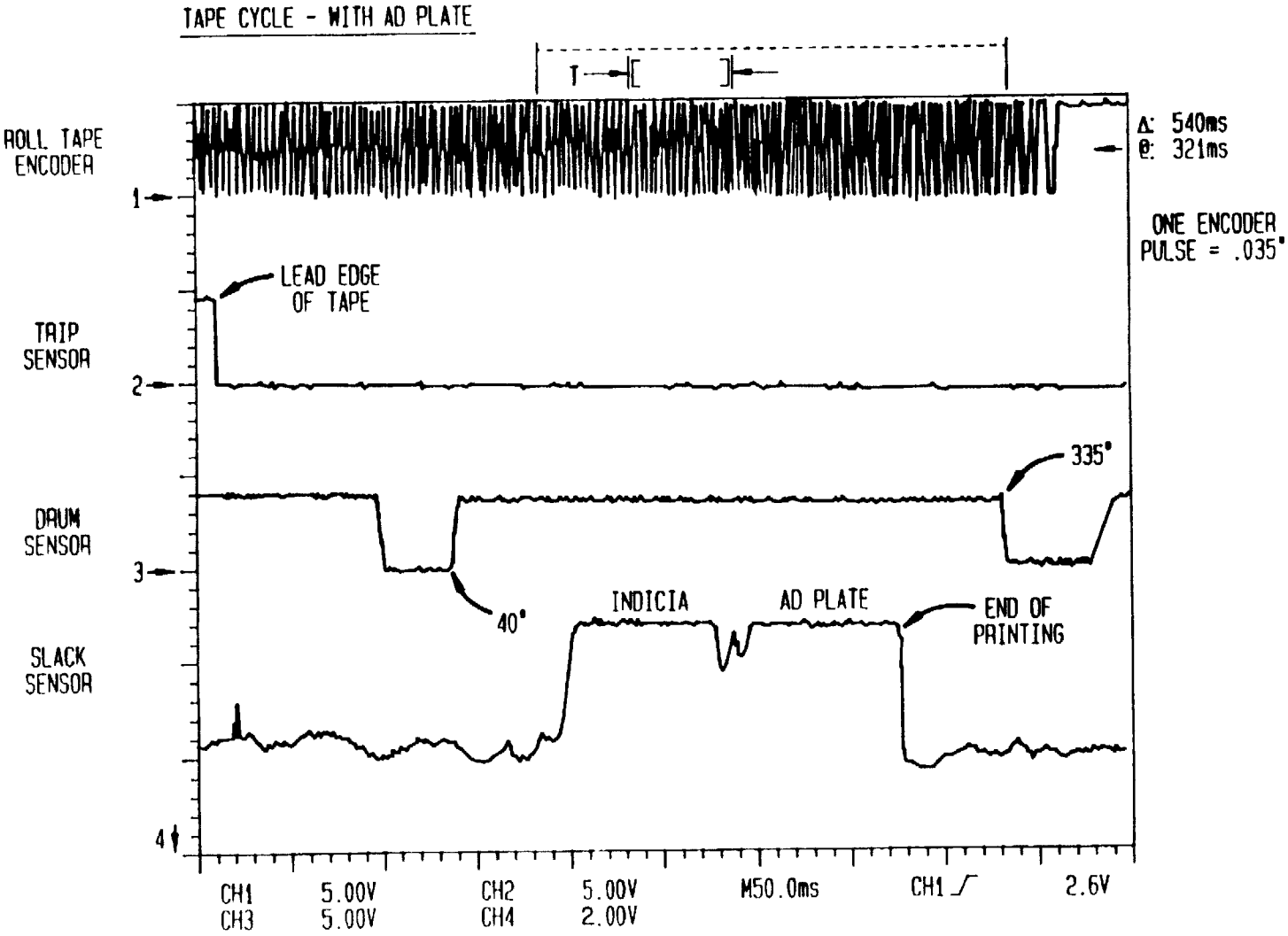
FIG. 9 shows the timing with the ad plate printed.

FIG. 8 is a timing plot of the previously described signals showing the timing of a tape cycle without the ad plate being printed and FIG. 9 shows the timing with the ad plate printing.

What is claimed is:

1. A method for controlling a tape motor for feeding tape if correspondence to printing of an indeterminate length of printing on the ape by a print drum comprising the steps of:

a) providing a micro controller operative to control a tape motor;

b) providing a sensor for indenting a tape condition which changes in accordance with the engagement of a printing portion of the print drum with the tape;

c) providing an optical sensor and slotted disk for providing signals indicative of the rotation of a motor shaft of the tape motor;

d) providing at least first and second counters for counting signal pulses from said optical sensor corresponding to the passage of slots during rotation of the motor;

e) energizing the motor for feeding tape;

f) counting the signal pulses in said first and second counters; and g) based on said counts if signal pulses in said first and second counters and the sensor indicated tape condition, the micro controller determining the timing of control signals of controlling the motor in correspondence to the length of printing on the tape.

2. The method of claim 1 further comprising a third counter for counting said signal pulses, said third counter being set to account for any gaps in printing segments of the print drum such that unwanted braking of the motor does not occur due to said gaps.

3. The method of claim 1 wherein the sensor is a proximity sensor arranged for detecting a change in distance of the tape from the sensor when the tape is being printed as opposed to the time no printing is occurring.

4. The method of claim 3 wherein the speed of the tape feed motor is intentionally less than the speed of the print drum such that the tape motor drive pushes the tape when the print drum is not printing and the print drum pulls the tape while the drum is printing whereby the distance to the proximity sensor is changed in dependence upon the pulling and pushing of the tape.

5. A method for controlling a tape motor in a mailing machine for feeding tape in correspondence to printing of an indeterminate length of printing on the tape by a postage meter print drum, the method comprising the steps of:

a) providing a micro controller operative to control a tape motor;

b) providing proximity sensor near a tape path for indicating a distance between said sensor and a tape in the path, said distance changing in accordance with the engagement of a printing portion of the print drum with the tape;

c) providing an optical sensor and slotted disk for providing signals indicative of the rotation of a motor shaft of the tape motor;

d) providing at least first and second counters for counting signal pulses from said optical sensor corresponding to the passage of slots during rotation of the motor;

e) energizing the tape motor for feeding tape; and f) counting the signal pulses in said first and second counters and providing said counts of said first and second counters and the indication from the proximity sensor of the indication of printing by the print drum to the micro controller for determining the timing of control signals for controlling the motor in correspondence to the length of printing on the tape.

6. The method of claim 5 wherein the speed of the tape feed motor is intentionally less than the speed of the print drum such that the tape motor drive pushes the tape when the print drum is not printing and the print drum pulls the tape while the drum is printing whereby the distance to the proximity sensor is changed in dependence upon the pulling and pushing of the tape.

7. The method of claim 5 further comprising a third counter for counting said signal pulses, said third counter being set to account for any gaps in printing segments of the print drum such that unwanted braking of the motor does not occur due to said gaps.

8. A method for controlling a tape motor for feeding tape in correspondence to printing of an indeterminate length of printing on the tape by a print drum, the method comprising the steps of:

a) energizing, via a micro controller, a motor operatively communicating with a tape supply roll for feeding tape to the print drum;

b) utilizing a sensor for indicating whether a printing portion of the print drum is engaging the tape;

c) detecting an amount of rotation of a motor shaft of the motor via an optical sensor and slotted disk, the optical sensor providing signal pulses corresponding to the passage of slots in the slotted disk by the optical sensor during rotation of the motor;

d) counting signal pulses in a first counter, the number of counted signal pulses in the first counter corresponding to a length of tape to be cut;

e) counting signal pulses in a second counter;

f) comparing the number of counted signal pulses in the second counter to a predetermined number of signal pulses to determine if a predetermined relationship exists between, the number of counted signal pulses in the second counter and the predetermined number of signal pulses; and g) if the predetermined relationship is determined to exist during step f), utilizing the micro controller for braking the motor to end feeding the tape.

9. A method as recited in claim 8, further comprising, subsequent to step g), determining the length of tape to be cut based on the counted number of signal pulses in the first counter, energizing the motor via the micro controller for feeding the length of tape to be cut to a cutting mechanism, and cutting the length of tape to be cut.

10. A method as recited in claim 8, further comprising detecting via the sensor when a leading edge of the first printing portion of the print drum engages the tape; detecting via the sensor when a trailing edge of a first printing portion of the print drum engages the tape; setting a third counter equal to zero and then counting the signal pulses from the optical sensor in the third counter; determining if the number of counted signal pulses in the third counter is greater than a predetermined number of signal pulses corresponding to an unacceptable gap between the first printing portion and a trailing second printing portion of the print drum; and if the number of counted signal pulses in the third counter is greater than the predetermined number of signal pulses corresponding to the unacceptable gap, determining if the meter should be braked based on the number of counted signal pulses in the second counter.

* * * * *